US009592429B1

(12) United States Patent
Wolfe

(10) Patent No.: US 9,592,429 B1
(45) Date of Patent: Mar. 14, 2017

(54) TENNIS COURT BALL RETAINER

(71) Applicant: Robert W. Wolfe, Pittsburgh, PA (US)

(72) Inventor: Robert W. Wolfe, Pittsburgh, PA (US)

( * ) Notice: Subject to any disclaimer, the term of this patent is extended or adjusted under 35 U.S.C. 154(b) by 0 days.

(21) Appl. No.: 15/137,060

(22) Filed: Apr. 25, 2016

(51) Int. Cl.
*A63B 61/00* (2006.01)
*A63B 47/02* (2006.01)

(52) U.S. Cl.
CPC ..... *A63B 61/00* (2013.01); *A63B 47/02* (2013.01)

(58) Field of Classification Search
USPC ..... 473/503, 455, 183, 153
See application file for complete search history.

(56) References Cited

U.S. PATENT DOCUMENTS 4,336,939 A * 6/1982 Krumlauf ..... A63F 7/0628 473/183
4,575,081 A 3/1986 Cavanagh
4,634,130 A * 1/1987 Simjian ..... A63B 57/357 273/DIG. 26
5,141,226 A 8/1992 Cavanagh
7,399,241 B1 * 7/2008 Thomas, Sr. ..... A63B 69/0002 473/422
2003/0073519 A1 4/2003 Shau
2012/0322589 A1 12/2012 Harris et al.

* cited by examiner

*Primary Examiner* — Aarti B Berdichevsky
*Assistant Examiner* — Christopher Glenn
(74) *Attorney, Agent, or Firm* — Carothers and Carothers

(57) ABSTRACT

A tennis court ball retainer having a horizontally extending ball gutter along the tennis court back wall which has an upwardly facing channel dimensioned to receive and retain tennis balls. An upright flexible upper backdrop curtain coextends directly above and along the ball gutter for engaging tennis balls striking the upper curtain, thereby dampening the tennis ball impact and directing the engaged tennis balls to fall into the ball gutter for retention. A tennis court floor surface ball retainer is also provided and coextends with and under the ball gutter. The ball gutter extends a uniform distance above the tennis court floor surface and includes an upright flexible lower backdrop curtain coextending below and along the ball gutter for engaging and trapping tennis balls striking this lower curtain by rolling or skidding on the tennis court floor surface. The lower curtain is draped to provide a sagging horizontal droop therein which is positioned a predetermined distance above the tennis court floor surface wherein this distance is dimensioned for thereby capturing and retaining tennis balls between the droop and the tennis court floor surface.

4 Claims, 3 Drawing Sheets

TENNIS COURT BALL RETAINER

BACKGROUND OF THE INVENTION

The present invention pertains to a tennis ball retainer for a tennis court.

In a tennis match on an indoor court when a service return is missed or a ground stroke eludes the defending player, the ball hits the back wall of the court (which is covered with a vinyl backdrop curtain, normally hung from a cable about a foot or more from the wall) and then the ball often rolls back on to the court. This requires the receiver to either pick up the ball, or more often, to roll it towards the back of the court slowly with the hope that it remains close enough to the wall to avoid the hazard of an accident by stepping on the ball during subsequent play.

Another annoying problem is that the balls often escape from the court to an adjacent court, interrupting play on both courts.

The problems of outdoor tennis courts are generally similar to those of indoor courts. The primary difference between indoor and outdoor tennis courts is that the outdoor courts have a chain link fence surrounding them. Further, most outdoor courts do not have mesh curtains between the courts.

It is the principal object of the present invention to provide a tennis court ball retainer that will receive and retain tennis balls that strike the back wall of the tennis court and provide easy access and retrieval of the collected balls by the players.

SUMMARY OF THE INVENTION

The tennis court ball retainer of the present invention includes a horizontally extending ball gutter having an upwardly facing channel dimensioned to receive and retain tennis balls. An upright flexible upper backdrop curtain coextends directly above and along this ball gutter for engaging tennis balls that strike this top curtain, thereby dampening the tennis ball impact and directing the engaged tennis balls into the ball gutter for retention.

In addition, a tennis court floor surface ball retainer is also provided which coextends with and under the aforesaid ball gutter. The ball gutter extends a uniform distance above the tennis court floor surface and includes an upright flexible lower backdrop curtain coextending below and along the ball gutter for engaging and trapping tennis balls striking this lower curtain by skidding or rolling on the tennis court floor surface toward the back wall of the court. The lower curtain is draped to provide a sagging horizontal droop therein which is positioned a predetermined distance above the tennis court floor surface wherein this distance is dimensioned for thereby capturing and retaining tennis balls between the lower curtain droop and the tennis court floor surface for later retrieval.

The upper backdrop curtain may also be draped to provide a horizontal droop extending along a bottom edge of this upper curtain for assisting the guidance of tennis balls falling downwardly along the upper curtain into the ball gutter. The lower curtain droop is positioned in front of a backdrop ball stop wall to assist in positioning and retaining a tennis ball between the lower curtain droop and the tennis court floor surface.

A vertical panel may be positioned at a right angle to the upper backdrop curtain along a side edge thereof for deflecting tennis balls back toward the court.

Before the tennis balls that are retained in the gutter, the player retrieves them either by pulling the ball out with the head of his or her racket, or be reaching down and grasping the ball with his or her free hand. For those balls that roll back on to the court, the player simply rolls them with his or her racket back along the surface of the court floor toward the second lower ball retainer.

BRIEF DESCRIPTION OF THE DRAWINGS

Other objects and advantages appear hereinafter in the following description of the invention. The accompanying drawings show, for the purpose of exemplification, without limiting the scope of the invention or appended claims, certain practical embodiments of the present invention wherein:

DETAILED DESCRIPTION OF THE DRAWINGS

Figure 1:
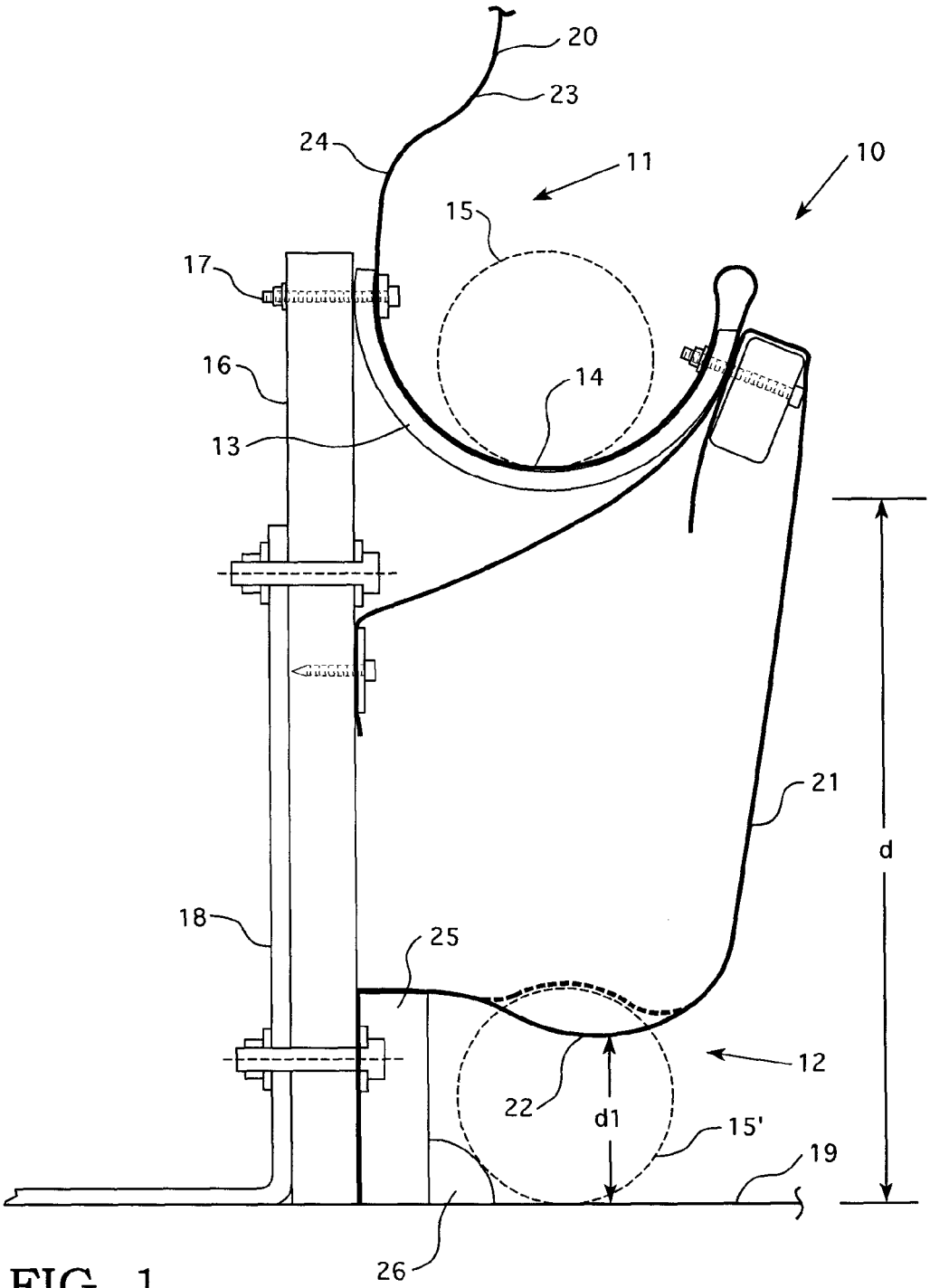
FIG. 1 is a schematic view in side elevation illustrating the tennis court ball retainer of the present invention.

Referring to FIG. 1, the tennis court ball retainer 10 of the present invention generally consists of an upper ball retrieving and retaining section 11 and a lower tennis ball retrieving and retaining section 12.

The upper section 11 is generally comprised of a horizontally extending ball gutter 13 having an upwardly facing channel 14 dimensioned to receive and retain tennis balls 15 therein. The gutter 14 may be constructed of PVC and secured to a backboard 16 by screws 17. Backboard 16 is in turn held upright in position by L brackets 18 which may be secured to the tennis court floor surface 19.

An upright flexible upper backdrop curtain 20 coextends directly above and along the ball gutter 13 for engaging tennis balls striking upper curtain 20 and thereby dampening the tennis ball impact and directly the engaged tennis balls downwardly into ball gutter 13 for retention as illustrated by tennis ball 15 resting in gutter 13.

This configuration of ball gutter 13, upper backdrop curtain 20 and backstop wall 13 extends across the back of a tennis court and provides two means for retaining tennis balls at the back of the court where they will hold the balls while keeping them clearly visible for player retrieval. The first means for retaining tennis balls at the back of the court has already been described in the combination of gutter 13 and upper backdrop curtain 20. The second means for retaining tennis balls at the back of the tennis court is provided by lower section 12 of the ball retainer 10. It is here illustrated that ball gutter 13 extends a uniform distance d above the tennis court floor surface 19. This tennis court floor surface ball retainer section 12 includes an upright flexible lower backdrop curtain 21 coextending below and along ball gutter 13 for engaging and trapping tennis balls 15' striking lower curtain 21 by skidding or rolling on tennis court floor surface 19. Lower curtain 21 is draped and retained behind board 25 to provide a sagging horizontal droop 22 therein which is positioned a predetermined distance dl above the tennis court floor surface 19 wherein this distance dl is dimensioned for thereby capturing and retaining tennis balls between the droop 22 and tennis court floor surface 19.

The upper and lower backdrop curtains 20 and 21 are of a flexible material, such as vinyl. The upper backdrop curtain 20 may also be draped to provide a horizontal droop 23 extending along a bottom edge 24 of upper backdrop curtain 20 for assisting the guidance of tennis balls falling downwardly along upper curtain 20 into gutter 13.

The lower ball retrieving and retaining system of section 12 is also preferably provided with a backdrop ball stop in the form of quarter round molding 26 which is contoured to deflect the incoming balls up into the drooping backdrop curtain 21 at droop 22.

Figure 2:
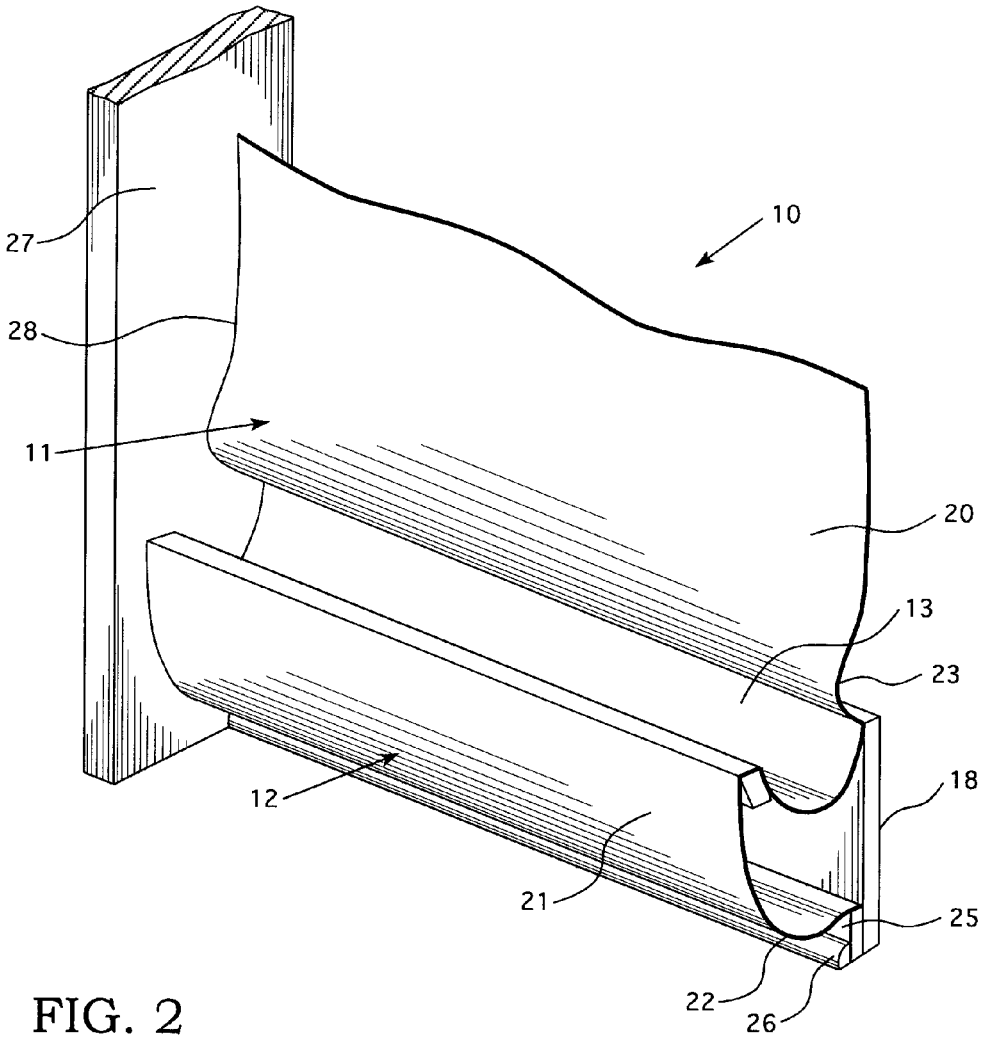
FIG. 2 is a schematic isometric front view of the tennis court ball retainer shown in FIG. 1 with the addition of a vertical side panel at one side edge thereof to assist in deflecting errant tennis balls back into the court.

Referring next to FIG. 2. A schematic front view illustration of the ball retainer shown in FIG. 1 is illustrated and includes a vertical panel 27 which is provided at approximately a right angle to the upper backdrop curtain 20 along side edge 28 for deflecting errant tennis balls back into the tennis court which are deflected off the upper curtain 20 to the side.

Figure 3:
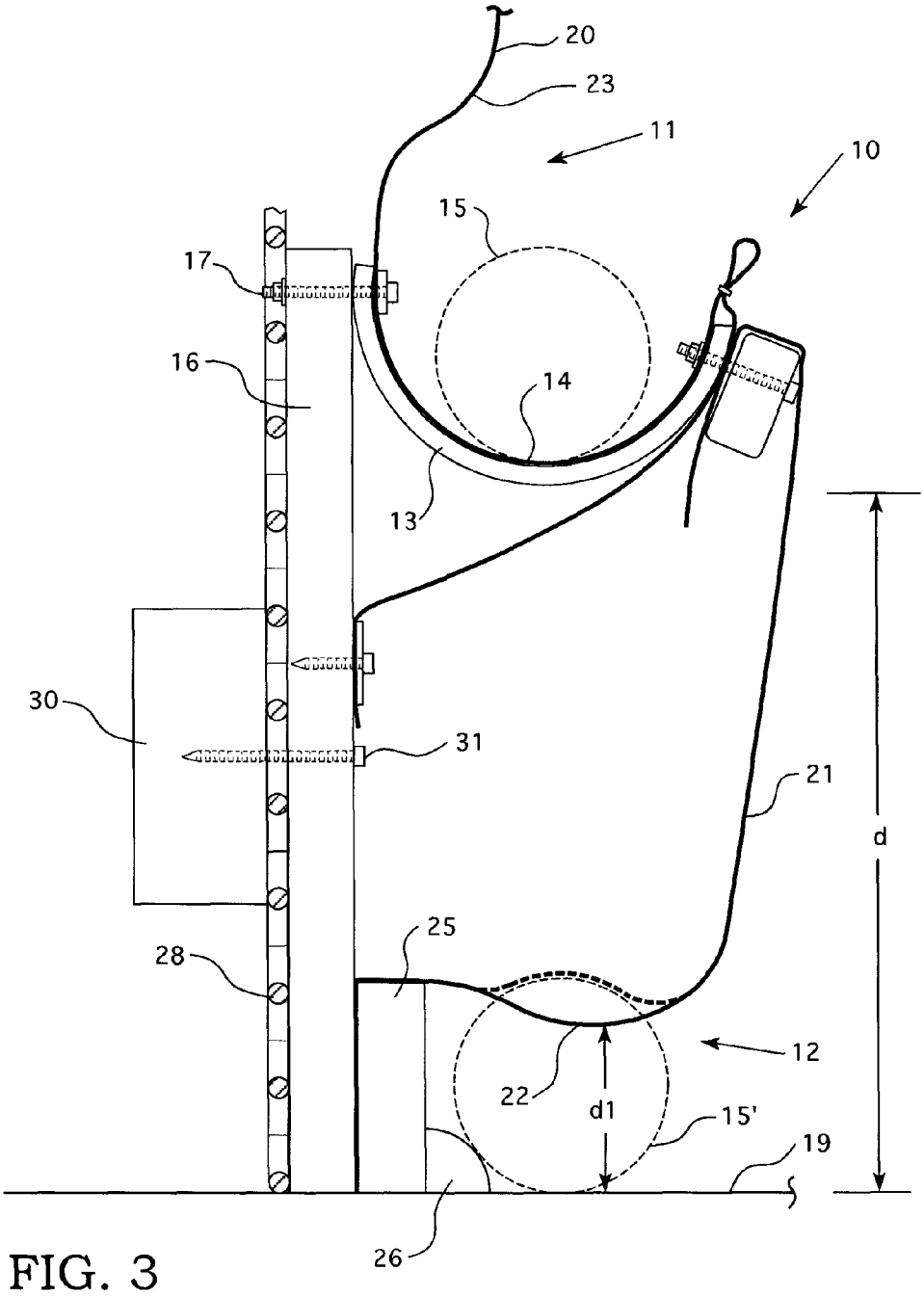
FIG. 3 is a schematic view in side elevation illustrating the tennis court ball retainer of the present invention as applied to chain link fence in an outdoor tennis court.

Referring next to FIG. 3, the tennis court ball retainer of the present invention is here illustrated in use on an outdoor tennis court. It is generally similar to that for the indoor courts illustrated in FIGS. 1 and 2, and therefore like elements are designated with the same reference numerals. The primary difference is that in this configuration the ball retainer is adapted to utilize the chain link fence 28 at the back of the tennis court.

In this illustration the backboard 16 is secured directly to the chain link fence 28 at the back of the tennis court by means of board 30 and screw 31 which thereby sandwiches the linked fence 28 between backboard 16 and retaining board 30.

In all other respects, this outdoor system functions and operates in an identical manner as the ball retainer illustrated in FIGS. 1 and 2.

I claim:

1. A tennis court ball retainer comprising:

a horizontally extending ball gutter having an upwardly facing channel dimensioned to receive and retain tennis balls;

an upright flexible upper backdrop curtain coextending directly above and along said ball gutter for engaging tennis balls striking said upper curtain and thereby dampening the tennis ball impact and directing the engaged tennis balls into said ball gutter for retention; and a tennis court floor surface ball retainer coextending with and under said ball gutter, said ball gutter extending a uniform distance above a tennis court floor surface, and including an upright flexible lower backdrop curtain coextending below and along said ball gutter for engaging and trapping tennis balls striking said lower curtain by rolling on said tennis court floor surface, said lower curtain draped to provide a downwardly sagging horizontal droop therein, said droop positioned under and along said gutter and positioned a predetermined distance above the tennis court floor surface wherein said predetermined distance is dimensioned to be less than the diameter of a tennis ball for thereby capturing and retaining tennis balls between said droop and the tennis court floor surface.

2. The tennis court ball retainer of claim 1, wherein said upper backdrop curtain draped to provide a horizontal droop extending downwardly along a bottom edge of said upper curtain and outwardly over a portion of said gutter for assisting the guidance of tennis balls falling downwardly along said upper curtain into said gutter.

3. The tennis court ball retainer of claim 1, wherein said lower curtain droop is positioned in front of a backdrop ball stop with an upwardly facing surface contoured to deflect balls upward into said lower curtain droop.

4. The tennis court ball retainer of claim 1, including a vertical panel positioned at a right angle to said upper backdrop curtain along a side edge of said upper backdrop curtain for deflecting tennis balls.

* * * * *